US005167782A

United States Patent [19]

Marlow

[11] Patent Number: 5,167,782

[45] Date of Patent: Dec. 1, 1992

[54] METHOD AND APPARATUS FOR TREATING FUEL

[76] Inventor: John R. Marlow, P.O. Box 91237, Henderson, Nev. 89009

[21] Appl. No.: 675,651

[22] Filed: Mar. 27, 1991

[51] Int. Cl.[5] ..... F02M 27/04; C25B 11/04

[52] U.S. Cl. ..... 204/168; 123/538; 204/293

[58] Field of Search ..... 123/538, 536; 204/168, 204/293, 292

[56] References Cited

U.S. PATENT DOCUMENTS 4,176,637 12/1979 Cole ..... 123/538

4,469,076 9/1984 Wolff ..... 123/536

4,715,325 12/1987 Walker ..... 103/538

4,930,483 6/1990 Jones ..... 123/538

5,044,347 9/1991 Ullrich et al. ..... 123/538

*Primary Examiner*—John Niebling

*Assistant Examiner*—Brian M. Bolam

*Attorney, Agent, or Firm*—Tod R. Nissle

[57] ABSTRACT

A method for treating fluid hydrocarbon fuel to improve the combustion characteristics of the fuel. The method comprises applying a controlled electromotive force to an alloy which is in contact with the fuel. The electromotive force builds up an electrical charge in the alloy.

9 Claims, 3 Drawing Sheets

METHOD AND APPARATUS FOR TREATING FUEL

BACKGROUND OF THE INVENTION

1. Field of the Invention

This invention relates to a method and apparatus for treating fuel to improve the combustion characteristics of the fuel.

More particularly, the invention relates to a method and apparatus for treating fluid hydrocarbon fuel by applying a controlled electromotive force to an alloy which is in contact with the fuel.

2. Description of Related Art

Carbon dioxide, hydrocarbon, and other polluting emissions produced during the combustion in an automobile of gasoline or another hydrocarbon fuel causes large scale air pollution in most industrialized countries in the world. Ways and means have long been sought to reduce the quantity of pollutants produced for each gallon of fuel which is consumed.

SUMMARY OF THE INVENTION

In accordance with the invention, I have discovered a new method and apparatus which effectively improves the combustion properties of hydrocarbon fuels to reduce the quantity of carbon dioxide and hydrocarbon pollutants which are generated during combustion of the fuel and which increases the mileage achieved by a vehicle utilizing the improved hydrocarbon fuel. My method comprises building up an electric charge on one or more alloys and contacting the charged alloy with the hydrocarbon fuel. In the first embodiment of the invention, the alloy can include 60 to 80% by weight tin, 10 to 35% by weight antimony, 1 to 9% by weight lead, and 2 to 12%. The alloy can also include 2 to 40% by weight silicon and/or 0.01 to 2.5% by weight trace elements. In a second embodiment of the invention, the alloy comprises a common foundry brass which can include 5 to 30% by weight nickel, 1 to 20% by weight tin, 30 to 60% by weight copper, 1 to 12% by weight lead, and 2 to 28% by weight zinc. The alloy can also include 0 to 10% by weight silver, 0.5 to 10% by weight silicon, 0.05 to 4.5% by weight antimony, and/or 0 to 2.5% by weight trace elements including iron and/or manganese. In a third embodiment of the invention, the alloy includes at least one component from the group consisting of antimony, lead, tin, selenium, mercury, molybdenum, manganese, aluminum, platinum, palladium, nickel, zinc, rhenium, silicon, ruthenium, copper, and iron. The alloy utilized in the first embodiment of the invention can be purchased from Carbonflo U.K. Ltd., of Salisbury England or from Powerplus Environmental Systems, Inc., of Kent, Conn., United States of America, and is also commonly known as the Broquet Formula alloy. The brass alloy utilized in the second embodiment of the invention is a common brass available from a variety of sources.

In practicing the method of the invention, a power source is presently utilized to build up a positive or negative electrical charge on the alloy. Alternating and/or direct current can be utilized to produce the electrical charge on the alloy, as can, if appropriate, electromagnetic waves or a magnetic field. The alloy can be electrically charged by induction or by directly contacting the alloy with a charged object. The alloys can be sacrificial and/or non-sacrificial. When the alloy is charged, heat may be generated. It is presently preferred that a positive electrical charge be built up on the Broquet Formula alloy utilized in the first embodiment of the invention, while a negative electrical charge be built up on the brass alloy utilized in the second embodiment of the invention. If desired, a negative charge can, however, be built up on the Broquet Formula alloy and a positive charge can be built up on the brass alloy. The fuel which contacts the electrically charged alloy can be diesel, methane, benzene, acetylene, gasoline or other hydrocarbon fuels derived from petroleum or other sources. The voltage of the power supply which is presently utilized to charge the Broquet Formula or brass alloy is three or more volts, but can be any voltage in excess of about one-tenth of a volt.

Although I do not wish to be bound by the following mechanisms, according to my present understanding it appears that when a positive or negative electromotive force is produced on the alloy utilized in the first embodiment of the invention, the alloy is sacrificial and that certain chemical components travel from the alloy into the fuel contacting the alloy. The chemical components which travel into the fuel chemically interact with the fuel to improve the combustion characteristics of the fuel. The alloy utilized in the second embodiment of my invention appears to be non-sacrificial and yet contribute toward a molecular change within the fuel.

As utilized herein, the term "combustion characteristics" includes but is not limited to the compression produced by the fuel in the combustion chambers of an engine, the RPM of the engine produced by combustion of the fuel, the ppm of carbon dioxide, hydrocarbons, and other combustion by-products in the exhaust of the engine; the miles per gallon achieved using the fuel; and, the temperature of the exhaust stream from the engine. The combustion characteristics of a fuel indicate the efficiency and completeness with which a fuel burns and indicates the power produced or work achieved by the apparatus using the fuel. The combustion characteristics of a fuel are improved when the fuel produces smaller quantities of carbon dioxide and other exhaust products, when the miles per gallon achieved with the fuel increase, when the temperature of the engine exhaust decreases, when the engine compression increases, when the engine RPM increases, etc.

In a fourth embodiment of my invention, I utilize a first alloy which is positively charged and a second alloy which is negatively charged. The first and second alloys are adjacent but spaced apart from one another in hydrocarbon fuel. When the first alloy is the alloy utilized in the first embodiment of my invention and when the second alloy consists of the alloy utilized in the second embodiment of my invention, unexpected and surprising improvements in the combustion characteristics of hydrocarbon fuels are achieved.

BRIEF DESCRIPTION OF THE DRAWINGS

Apparatus utilized in the practice of the invention is illustrated in the drawings, in which.

DESCRIPTION OF THE PREFERRED EMBODIMENTS

Figure 1:
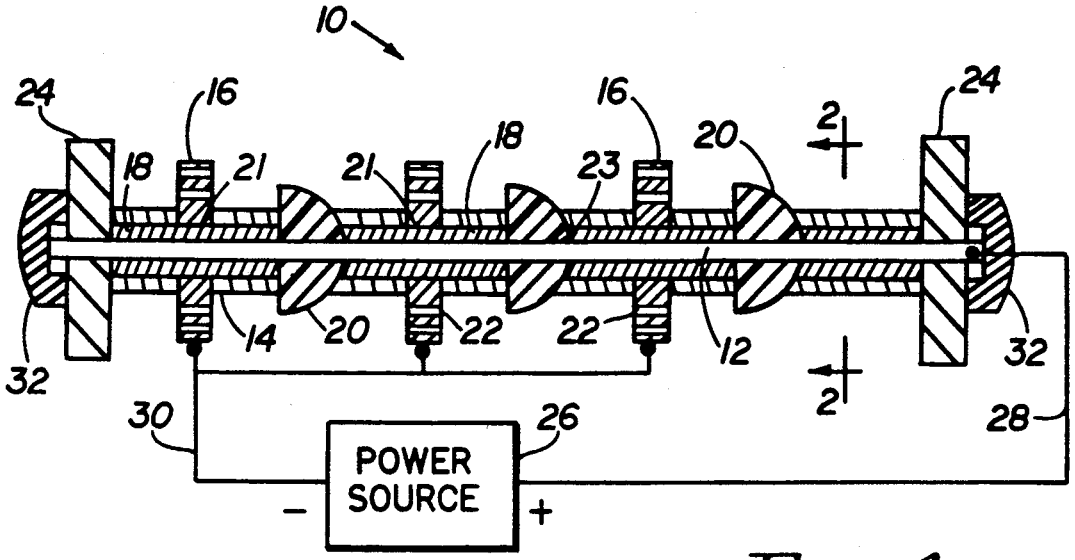
FIG. 1 is a side elevation sectional view illustrating fuel treatment apparatus constructed in accordance with the principles of my invention.

Turning now to the drawings, which depict the presently preferred embodiments of the apparatus of the invention for the purpose of illustrating the practice thereof and not by way of limitation of the scope of the invention, and in which like reference characters refer to corresponding elements throughout the several views, FIG. 1 illustrates a fuel treatment unit generally identified by reference character 10 and including elongate cylindrical electrically conductive rod 12. A dielectric disk 24 is attached to each end of rod 12. Disk 24 is fabricated from nylon or another desired dielectric material. Rod 12 extends through cylindrical apertures 23 formed through alloy cones 20. Each hollow cylindrical dielectric sleeve segment 18 extends intermediate a pair of alloy cones 20 or between an alloy cone 20 and a disk 24. Each segment 18 can comprise a dielectric epoxy film. Each segment 18 extends through an aperture 21 formed through an alloy plate 16. Dielectric cylindrical sleeve segments 14 interconnect and span the distance between adjacent cone 20—plate 16 pairs and between adjacent plate 16—disk 24 pairs. Sleeve segments 14 structurally support and strengthen plates 16 and disks 24. Alloy cones 20 are in direct electrical contact with rod 12. Apertures 22 are formed through cylindrical alloy plates 16. Dielectric caps 32 cover each end of rod 12. The negative terminal of battery or other power source 26 is connected to each plate 16 by lead 30. The postive terminal of power source 26 is connected to rod 12 by lead 28. The voltage produced by power source 26 is greater than 0.1 volt, preferably from 3 volts up to several tens of kilovolts.

Figure 3:
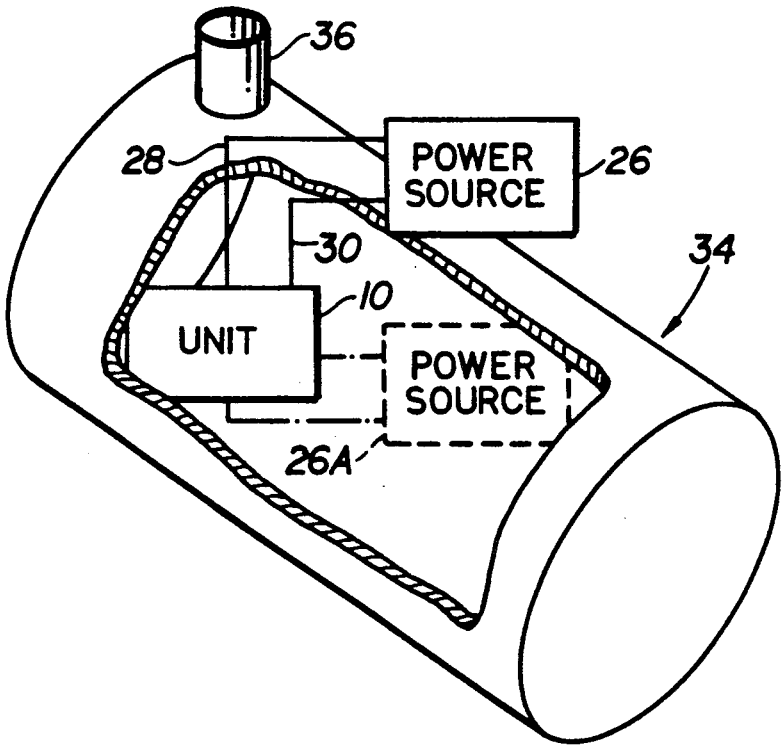
FIG. 3 is a perspective view illustrating a fuel supply vessel provided with the fuel treatment alloys of FIG. 1 installed therein; and, FIG. 4 is a side elevation section view illustrating the fuel treatment alloys of FIG. 1 installed in a cartridge which can be integrated in a fuel line.

In FIG. 3, a fuel treatment unit 10 is positioned inside a fuel container 34. Container 34 may comprise, for example, the fuel tank of a vehicle or a fuel storage or refining tank. Leads 30 and 28 connect external power source 26 to unit 10. Fuel may be directed into container 34 through spout 36. The power source can be mounted inside container 34 in the manner indicated by reference character 26A.

Figure 4:
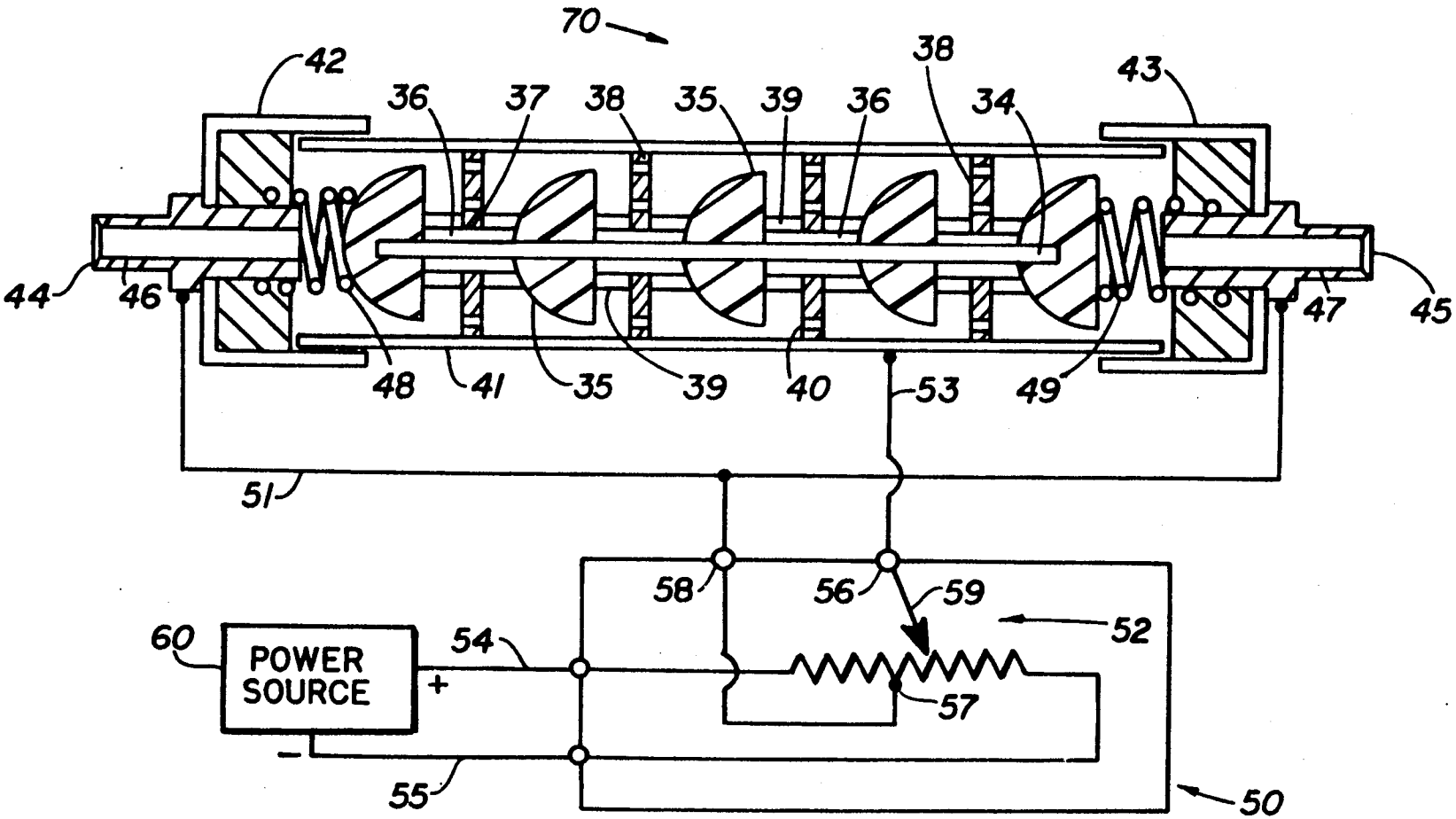

FIG. 4 illustrates a fuel treatment unit including a fuel treatment cartridge generally indicated by reference character 70. Cartridge 70 includes elongate cylindrical electrically conductive rod 34. Alloy cones 35 are mounted on and in direct electrical contact with rod 34. Each hollow cylindrical sleeve segment 36 extends between a pair of alloy cones 35. Each segment 36 can comprise a dielectric epoxy film. Each segment 36 extends through an aperture 37 formed through an alloy plate 38. Dielectric cylindrical sleeve segments 39 interconnect and span the distance between adjacent cone 35—plate 38 pairs. Sleeve segments 39 structurally strengthen the fuel treatment components. Apertures 40 are formed through cylindrical alloy plates 38. Apertures 40 facilitate the flow of fluid fuel through plates 38. Cylindrical electrically conductive housing or body 41 circumscribes cones 35, plates 38, rod 34, and sleeve segments 36, 39. Housing 41 is in direct electrical contact with the circular peripheral edges of plates 38. Dielectrically shielded cylindrical caps 42, 43 cover the ends of housing 41. Electrically conductive fuel line nozzle 44 is mounted in and extends through cap 42. Electrically conductive fuel line nozzle 45 is mounted in and extends through cap 43. Fuel flows through aperture 46 into housing 41, through apertures 40, and through aperture 47 to exit housing 41. Electrically conductive compressed spring 48 spans the distance between nozzle 44 and a cone 35. Electrically conductive compressed spring 49 spans the distance between nozzle 45 and a cone 35. Leads 51 and 53 connect terminals 58 and 56 of the control unit 50 to nozzle 44 and housing 41, respectively. Line 51 also connects terminal 58 to nozzle 45. Control unit 50 is connected to battery or other voltage source 60 by leads 54, 55 and includes potentiometer 52. Potentiometer 52 includes a neutral point 57 and wiper terminal 59. The control circuit 50 can be operated in well known fashion to reverse the polarity and potential of the charge applied to nozzles 44, 45 and housing 41.

The cones 20, 35 or the plates 16, 38 in FIGS. 1 and 5 can include or comprise an electrically conductive magnet. The cones and plates can be subjected to a power source producing an AC current over a DC current bias.

The fuel treatment unit of FIG. 4 can be constructed to provide multiple cartridges 70 and multiple electric circuits to provide power for the cartridges 70.

In use of the fuel treatment unit 10 of FIG. 1, the unit 10 is positioned in a container 34 of gasoline or other hydrocarbon fuel in the manner indicated in FIG. 3. Power source 26 builds up a positive electrical charge on alloy cones 20 and builds up a negative electrical charge on plates 16. The electrical charges on cones 20 and plates 16 cause current to flow through the fuel from plates 16 to cones 20 and cause the alloy cones 20 and plates 16 to interact with fuel in the container 34 to improve the combustion characteristics of the fuel. The fuel is in direct contact with alloy cones 20 and alloy plates 16. Although the interaction between the fuel in the tank and the plates 16 and cones 20 is believed to begin as soon as power source 26 is connected to cones 20 and plates 16, the effect of the unit 10 on fuel in the container 34 becomes more pronounced with time. While cartridge 70 is specifically designed to be installed in a fuel line, unit 10 can also, if desired, be placed in a fuel line. The line can be in a vehicle, a storage plant, refinery, etc.

In use of the fuel treatment unit of FIG. 4, the cartridge 70 is installed in the fuel line of a vehicle such that fuel from the line enters through nozzle 44, travels through the treatment unit, exits through nozzle 45 back into the fuel line, and then travels to the engine of the vehicle. The control unit 50 in FIG. 4 can, as earlier discussed, be utilized to alter the polarity and potential of nozzle 44 (and cones 35) and of housing 41 (and plates 38). The cartridge 70 of FIG. 5 can be utilized in a fuel line in a fuel storage facility, fuel production facility, furnace, or in any other desired location. The fuel line can be transporting fuel to a location where the fuel will be combusted, or to a location where the fuel will be stored or treated.

The following examples are presented, not by way of limitation of the scope of the invention, but to illustrate to those skilled in the art, the practice of various of the presently preferred embodiments of the invention and to distinguish the invention from the prior art.

EXAMPLE 1

The fuel treatment cartridge 70 of FIG. 4 was constructed, except that there were nine plates 16 (instead of the four shown in FIG. 4) and seven cones 20 (instead of the five shown in FIG. 4). The plates 38 were alternated with cones 35 along the length of rod 34 and of sleeves 36 and 39 in the manner shown in FIG. 4. The distance between each adjacent cone 35—plate 38 pair was one-quarter of an inch. Each plate 38 was about one and one-eighth inches in diameter and had a thickness of one-sixteenth of an inch. Each cone 35 had a base with a diameter of about seven-eighths of an inch and was about five-eighths of an inch high.

Each cone 35 in the cartridge 70 was purchased from Carbonflo U.K, Ltd. of Salisbury, England, and included about 70% by weight tin, 13.5% by weight antimony, 3% by weight lead, 5% by weight mercury, 7.5% by weight silicon, and 1% by weight trace elements. Each plate 16 was comprised of a common foundry brass and included about 13.45% by weight nickel, 2.69% by weight tin, 57.64% by weight copper, 0.07% by weight silicon, 7.66% by weight lead, 0.12% by weight antimony, 17.63 percent by weight zinc, 0.69% by weight lead, and 0.05% by weight manganese.

The cartridge 70 was integrated in the fuel line of a 1982 American Motor Company Eagle automobile having an odometer reading of 112,320 miles. The automobile had a six cylinder carbureted gasoline engine. Consequently, fuel traveling from the gasoline tank to the engine traveled through the cartridge 70 and moved over and contacted cones 35 and plates 38. Before cartridge 70 was integrated in the fuel line of the automobile, the average RPM at idle, the average compression at initial crank, the average compression at 2500 RPM, the average carbon dioxide (CO) emissions in ppm at 2500 RPM, the average hydrocarbon (HC) emission in ppm at 2500 RPM, the average miles per gallon, and the average temperature of the exhaust of the automobile were determined when eighty-seven octane normal unleaded gasoline was used as fuel. Several tanks of gasoline were used to drive the automobile about 700 miles. The amount of fuel consumed was divided into 700 to determine the miles per gallon. The temperature of the exhaust was determined by placing a pyrometer one inch away from and centered on the exhaust end of the tailpipe of the automobile. Readings for the RPM at idle, the compression at initial crank, the compression at 2500 RPM, the carbon dioxide (CO) emission in ppm at 2500 RPM, the hydrocarbon (HC) emissions in ppm at 2500 RPM, and the temperature of the exhaust were taken each time the gas tank in the automobile was filled and the automobile was conditioned. The automobile was conditioned by being driven in all manner of conditions including both highway and city operation, after which the readings were taken. The readings were averaged.

The fuel treatment cartridge 70 was installed immediately after the automobile had been driven 700 miles to determine the average miles per gallon achieved by driving the automobile on normal eighty-seven octane unleaded gasoline. When cartridge 70 was integrated in the fuel line, a battery was located outside of the fuel line. The leads of the battery led to plates 38 and cones 35 in the same manner that the leads 28, 30 of power source 26 lead to cones 20 and plates 16 of the fuel treatment unit 10 in FIG. 1. The battery produced a positive charge on cones 35 and a negative charge on plates 38. After cartridge 70 was installed in the fuel line, the automobile was driven 600 miles utilizing ordinary eighty-seven octane unleaded gasoline. After the automobile was driven 600 miles, several more tanks of eighty-seven octane gasoline were consumed and the automobile was driven an additional 800 miles. Readings for the RPM at idle, the compression at initial crank, the compression at 2500 RPM, the carbon dioxide (CO) emission in ppm at 2500 RPM, the hydrocarbon (HC) emission in ppm at 2500 RPM, and the temperature of the exhaust were taken each time the gas tank in the automobile was filled while the automobile was driven an additional 800 miles (in addition to the 700 and 600 mile segments previously driven). The readings obtained were averaged. The average miles per gallon of fuel was determined by dividing 800 by the gallons of fuel consumed. The below TABLE 1 summarizes the various readings obtained before and after cartridge 70 was integrated in the fuel line of the automobile.

TABLE 1

| | 1982 American Motor Company Eagle | | | | | | |
|---|---|---|---|---|---|---|---|
| | RPM at Idle | Average Compression at Initial Crank | Average Compression at 250 RPM | CO Emissions in PPM at 2500 RPM | Hydrocarbon Emissions in PPM at 2500 RPM | Miles per Gallon | Exhaust Temperature at Idle (°F.) |
| Without Cartridge 70. | 620 | 94 | 168 | 2.7 | | | |
| With Cartridge 70 | 730 | 128 | 192 | 0.3 | | | |
| Without Cartridge 70 Installed | | | | | 415 | 15.3 | 214 |
| With Cartridge 70 Installed in Fuel Line | | | | | 32 | 19.6 | 187 |

Note:
Each value in table with exception of Miles per Gallon values is an average of three or more readings each taken after a new tank of unleaded gasoline was put into the automobile.

After cartridge 70 was integrated in the fuel line the automobile engine started more quickly and had increased power and acceleration.

EXAMPLE 2

The fuel treatment unit 10 of FIG. 1 is constructed, except that there are nine plates 16 (instead of the four shown in FIG. 1) and seven cones 20 (instead of the four shown in FIG. 1). The plates 16 are alternated with cones 20 along the length of rod 12 and of sleeves 14 and 18 in the manner shown in FIG. 1. The distance between each adjacent cone 20—plate 16 pair is one-quarter of an inch. Each plate 16 is about one and one-eighth inches in diameter and has a thickness of one-sixteenth of an inch. Each cone 20 has a base with a diameter of about seven-eighths of an inch and is about five-eighths of an inch high.

Each cone 20 in unit 10 is purchased form Carbonflo U.K., Ltd. of Salisbury, England, and includes about 70% by weight tin, 13.5% by weight antimony, 3% by weight lead, 5% by weight mercury, 7.5% by weight silicon, and 1% by weight trace elements. Each plate 16 is comprised of a common foundry brass and includes about 13.45% by weight nickel, 2.69% by weight tin, 57.64% by weight copper, 0.07% by weight silicon, 7.66% by weight lead, 0.12% by weight antimony, 17.63% by weight zinc, 0.69% by weight lead, and 0.05% by weight manganese.

Unit 10 is placed inside and on the bottom of the fuel tank in a ten wheel diesel tractor-truck which pulls a moving van or other large trailer. Before unit 10 is installed in the fuel tank of the truck, the average stack temperature of the truck at idle, the peak horsepower at 1800 RPM, the average smoke opacity at maximum acceleration, the average smoke opacity at 1800 horsepower, and the average radiator fluid temperature are determined. The average miles per gallon is determined by driving the truck about 700 miles and dividing the 700 miles by the quantity of fuel consumed. The temperature of fluid in the radiator is determined by taking several readings after the truck is driven for about an hour at fifty miles per hour. The stack temperature, peak horsepower at 1800 RPM, smoke opacity at maximum acceleration, smoke opacity at peak horsepower are also determined by taking several readings after the truck is driven for about an hour. The stack temperature is determined by placing a pyrometer one inch away from and centered on the exhaust end of the stack of the truck. The fuel treatment unit 10 is installed in the fuel tank of the truck immediately after the truck is driven 700 miles to determine the average miles per gallon achieved by driving the truck on diesel fuel and to take the measurements referred to above. When unit 10 is installed in the fuel tank of the truck, six volt battery 26 is located outside of the fuel tank with leads 28 and 30 leading to plates 16 and cones 20 in the manner shown in FIG. 1 and by power source 26 in FIG. 3.

After unit 10 is installed in the fuel tank, the truck is driven 600 miles utilizing No. 2 diesel fuel. After the truck is driven 600 miles the truck is driven an additional 800 miles and readings are taken for the stack temperature at idle, the peak engine horsepower at 1800 RPM, the smoke opacity at maximum acceleration, the smoke opacity at peak horsepower, and the temperature of fluid in the radiator. Several readings are taken for the stack temperature at idle, the peak engine horsepower at 1800 RPM, the smoke opacity at maximum acceleration, the smoke opacity at peak horsepower, and the temperature of fluid in the radiator and the average of the readings is obtained. The below TABLE 2 summarizes the various readings obtained before and after member 10 is integrated in the diesel fuel tank of the truck.

TABLE 2

| | Tractor-Trailer Diesel Truck | | | | |
|---|---|---|---|---|---|
| | Stack Temperature at Idle (°F.) | Peak H.P. at 1800 RPM | Smoke Opacity at Max Acceleration | Smoke Opacity at Peak Horsepower | Temperature of Radiator Fluid (°F.) |
| Without Member 10 | 119 | 360 | 30 | 11 | 185 |

TABLE 2-continued

| | Tractor-Trailer Diesel Truck | | | | |
|---|---|---|---|---|---|
| | Stack Temperature at Idle (°F.) | Peak H.P. at 1800 RPM | Smoke Opacity at Max Acceleration | Smoke Opacity at Peak Horsepower | Temperature of Radiator Fluid (°F.) |
| With Member 10 | 91 | 371 | 12 | 4 | 185 |

The Joint TMC/SAE Fuel Consumption Test Procedures—Type II are applied and reveal that when unit 10 is installed in the fuel tank of a truck, a fuel saving improvement of from 2.4% to 5.6% is realized in comparison to the fuel consumption of the truck during the 600 miles prior to the installation of unit 10 in the fuel tank of the truck.

EXAMPLE 3

EXAMPLE 1 is repeated, except that plates 38 are replaced with copper plates of equal dimension. Improvements are still noted, but they are about 30 to 40% of those noted in EXAMPLE 1. For example, the gasoline mileage increases from 15.3 mpg to 16.7 mpg instead of from 15.3 mpg to 19.6 mpg; and, the CO emissions decreases from 2.7 ppm to 1.9 ppm instead if from 2.7 ppm to 0.3 ppm.

EXAMPLE 4

EXAMPLE 3 is repeated except that cones 35 include 80% by weight tin, 12.5% by weight antimony, 1% by weight lead, 2% by weight mercury, 2% by weight silicon, and 2.5% by weight trace elements. Similar results are obtained.

EXAMPLE 5

EXAMPLE 3 is repeated, except that cones 35 include 60% by weight tin, 34.99% by weight antimony, 1% by weight lead, 2% by weight mercury, 2% by weight silicon, and 0.01% by weight trace elements. Similar results are obtained.

EXAMPLE 6

EXAMPLE 3 is repeated, except that cones 35 include 60% by weight tin, 10% by weight antimony, 9% by weight lead, 12% by weight mercury, 6.5% silicon, and 2.5% trace elements. Similar results are obtained.

EXAMPLE 7

EXAMPLE 1 is repeated, except that cones 35 include 80% by weight tin, 12.5% by weight antimony, 1% by weight lead, 2% by weight mercury, 2% by weight silicon, and 2.5% by weight trace elements. Similar results are obtained.

EXAMPLE 8

EXAMPLE 1 is repeated, except that cones 35 include 60% by weight tin, 34.99% by weight antimony, 1% by weight lead, 2% by weight mercury, 2% by weight silicon, and 0.01% by weight trace elements. Similar results are obtained.

EXAMPLE 9

EXAMPLE 1 is repeated, except that cones 35 include 60% by weight tin, 10% by weight antimony, 9% by eight lead, 12% by weight mercury, 6.5% silicon, and 2.5% trace elements. Similar results are obtained.

EXAMPLE 10

EXAMPLE 1 is repeated except that the composition of plates 38 is altered such that each plate 38 includes 30% by weight nickel, 20% by weight tin, 30% by weight copper, 1% by weight lead, 0.05% by weight antimony, 5% by weight zinc, 5% by weight silicon, 5% by weight silver, 1% by weight iron, 1% by weight manganese and 2.5% by weight trace elements. Similar results are obtained.

EXAMPLE 11

EXAMPLE 1 is repeated except that the composition of each plate 38 is altered such that each plate 38 includes 30% by weight nickel, 1% by weight tin, 50% by weight copper, 8% by weight silicon, 4% by weight zinc, 2% by weight lead, 2.5% by weight antimony, and 2.5% by weight trace elements. Similar results are obtained.

EXAMPLE 12

EXAMPLE 1 is repeated except that the composition of each plate 38 is altered such that each plate 38 includes 5% by weight nickel, 5% by weight tin, 60% by weight copper, 25% by weight zinc, 2% by weight lead, 2% by weight silicon, and 1% by weight trace elements. Similar results are obtained.

EXAMPLE 13

EXAMPLE 1 is repeated, except that cones 35 are replaced by copper cones of equal dimension. Improvements are still noted in the engine combustion and performance criteria noted in TABLE 1, but the improvements are about 20% to 30% of those achieved in EXAMPLE 1. For example, the gasoline mileage increases from 15.3 mpg to 16.2 mpg instead of from 15.3 mpg to 19.6 mpg; and, the CO emission decreases from 2.7 ppm to 2.2 ppm instead of from 2.7 ppm to 0.3 ppm.

EXAMPLE 14

EXAMPLE 13 is repeated except that the composition of plates 38 is alterated such that each plate 38 includes 30% by weight nickel, 20% by weight tin, 30% by weight copper, 1% by weight lead, 0.05% by weight antimony weight zinc, 5% by weight silicon, 5% by weight silver, 1% by weight iron, 1% by weight manganese and 2.5% by weight trace elements. Similar results are obtained.

EXAMPLE 15

EXAMPLE 13 is repeated except that the composition of each plate 38 is altered such that each plate 38 includes 30% by weight nickel, 1% by weight tin, 50% by weight copper, 8% by weight silicon, 4% by weight zinc, 2% by weight lead, 2.5% by weight antimony, and 2.5% by weight trace elements. Similar results are obtained.

EXAMPLE 16

EXAMPLE 13 is repeated except that the composition of each plate 38 is altered such that each plate 38 includes 5% by weight nickel, 5% by weight tin, 60% by weight copper, 25% by weight zinc, 2% by weight lead, 2% by weight silicon, and 1% by weight trace elements. Similar results are obtained.

EXAMPLE 17

EXAMPLE 10 is repeated, except that the trace elements in plates 38 include 0.5% by weight aluminum, 0.05% by weight molybdenum, 0.05% by weight platinum, 0.5% by weight ruthenium. Similar results are obtained.

EXAMPLE 18

EXAMPLE 1 is repeated, except that the trace elements in cones 35 include 0.05% by weight aluminum, 0.05% by weight molybdenum, 0.05% by weight platinum, 0.05% by weight palladium, 0.05% by weight rhenium, and 0.05% by weight ruthenium. Similar results are obtained.

EXAMPLE 19

Figure 2:
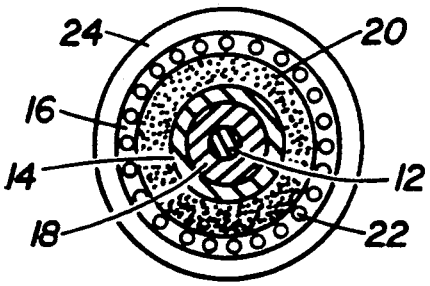
FIG. 2 is a transverse sectional view illustrating the fuel treatment apparatus of FIG. 1 and taken along section line 2—2 thereof.

The fuel treatment unit 10 of FIGS. 1 and 2 was constructed, except that there were six plates (instead of the four shown in FIG. 1) and seven cones 20 (instead of the four shown in FIG. 1). The plates 16 were alternated with cones 20 along the length of rod 12 and of sleeves 14 and 18 in the manner shown in FIG. 1. The distance between each adjacent cone 20—plate 16 was one-quarter of an inch, Each plate 16 was about one and one-eighth inches in diameter and had a thickness of one-sixteenth of an inch. Each cone 20 had a base with a diameter of about seven-eighths of an inch and was about five-eighths of an inch high.

Each cone 20 in unit 10 was purchased from Carbonflo U.K., Ltd. of Salisbury, England, and included about 70% by weight tin, 13.5% by weight antimony, 3% by weight lead, 5% by weight mercury, 7.5% by weight silicon, and 1% by weight trace elements. Each plate 16 was comprised of a common foundry brass and included about 13.45% by weight nickel, 2.69% by weight tin, 57.64% by weight copper, 0.07% by weight silicon, 7.66% by weight lead, 0.12% by weight antimony, 17.63% by weight zinc, 0.69% by weight lead, and 0.05% by weight manganese.

Unit 10 was provided with a power supply or source 26 capable of delivering an electromotive force of from 6 to 120 volts. The positive lead 28 from source 26 was connected to rod 12. The negative lead 30 was connected to plates 16.

Three 120 milliliter samples of No. 2 diesel fuel were obtained. The first sample was not treated by the method and apparatus of the invention.

The second sample was placed in a glass beaker. Unit 10 was also placed in the beaker in contact with the fuel for a seven hour period. Electric energy was not applied to cones 20 and plates 16 of unit 10 during the seven hour period. After the seven hour period had expired, unit 10 was removed from the beaker.

The third 120 milliliter sample of No. 2 diesel fuel was placed in a glass beaker. After being removed from the beaker containing the second sample of diesel fuel, unit 10 was placed in the beaker with the third sample of diesel fuel. Unit 10 was in contact with the fuel. Source 26 was utilized to apply electric energy to cones 20 and plates 16 and create a six volt potential. The six volt potential was applied for a seven hour period. After the six volt potential was applied for only an hour, the fuel began to darken. Although the fuel darkened, visual examination of the fuel detected no gum formation in the fuel. The fuel remained clear. At the end of the seven hour period, unit 10 was removed from the glass beaker.

The first, second, and third samples of No. 2 diesel fuel were then tested under the ASTM D-86 Distillation test. The following TABLE 3 summarizes the results of the test.

TABLE 3

| ASTM D-86 DISTILLATION TEST OF NO. 2 DIESEL FUEL | | | |
|---|---|---|---|
| | READINGS IN DEGREES FAHRENHEIT | | |
| | SAMPLE #1 | SAMPLE #2 | SAMPLE #3 |
| IBP* | 346 | 347 | 356 |
| 05% | 404 | 403 | 410 |
| 10% | 427 | 426 | 432 |
| 15% | 440 | 442 | 446 |
| 20% | 454 | 454 | 457 |
| 30% | 478 | 476 | 480 |
| 40% | 501 | 500 | 500 |
| 50% | 525 | 526 | 525 |
| 60% | 548 | 548 | 552 |
| 70% | 570 | 572 | 572 |
| 80% | 596 | 597 | 595 |
| 90% | 628 | 630 | 625 |
| 95% | 656 | 656 | 651 |
| FBP** | 678 | 676 | 676 |
| REC*** | 98.3 | 97.8 | 99.3 |
| LOSS | 0.7 | 0.7 | 0.5 |
| RES**** | 1.0 | 1.5 | 0.2 |

*IBP = initial boiling point.
**FBP = final boiling point.
***REC = percent recovered.
****RES = residue.
NOTES:
1. SAMPLE #1 not treated.
2. SAMPLE #2 treated by contacting the fuel with unit 10 for seven hours without applying voltage to unit 10.
3. SAMPLE #3 treated by contacting the fuel with unit 10 for seven hours while seven volt potential applied to unit 10.

It is believed that the flow of current through the unleaded gasoline, leaded gasoline, diesel fuel and other conventional hydrocarbon fuels which can be utilized in the practice of the invention is facilitated by the presence of small amounts of tin and other electrically conductive elements in the fuel. Most fuel includes small amounts of water and of air and other gases.

As demonstrated by the foregoing examples, the amount of each electrically conductive metallic component or element which comprises an alloy member used in the practice of the invention can be large or can be small. A metallic component may be up to 70% or more by weight of the alloy member, or, a metallic component may appear in an alloy member in only a trace amount. Accordingly, by way of example, an alloy member can consist only of copper with a trace amount of some other metal.

Having described my invention in such terms as to enable those skilled in the art to understand and practice it, and having identified the presently preferred embodiments thereof, I claim:

1. A method for treating fluid hydrocarbon fuel to improve the efficiency of combustion of the fuel, said method including the steps of (a) contacting a first electrically conductive alloy member and a second electrically conductive member with said fuel, said second member being spaced apart from said first member, said first alloy member including 5 to 30% by weight nickel, 1 to 20% by weight tin, 30 to 70% by weight copper, 1 to 20% by weight lead, and 2 to 28% by weight zinc; and, (b) applying electric energy to said first and second members to (i) build up an electrical charge on said first and second members, and (ii) create an electromotive force that causes an electric current to flow through said fuel from one of said members to the other of said members.

2. A method for treating fluid hydrocarbon fuel to improve the efficiency of combustion of the fuel, said method including the steps of (a) contacting a first electrically conductive alloy member and a second electrically conductive member with said fuel, said second member being spaced apart from said first member, said first alloy member including 60 to 80% by weight tin, 10 to 35% by weight antimony, 1 to 9% by weight lead, and 2 to 12% by weight mercury; and, (b) applying electric energy to said first and second members to (i) build up an electrical charge on said first and second members, and (ii) create an electromotive force that causes an electric current to flow through said fuel from one of said members to the other of said members.

3. The method of claim 1 wherein said fuel includes at least one component selected from the class consisting of water and gases.

4. The method of claim 2 wherein said fuel includes at least one component selected from the class consisting of water and gases.

5. The method of claim 1 wherein said second member comprises an alloy including 60 to 80% by weight tin, 10 to 35% by weight antimony, 1 to 9% by weight lead and 2 to 12% by weight mercury.

6. The method of claim 5 where said second member includes 2 to 40% by weight silicon.

7. The method of claim 2 wherein said alloy member includes 2 to 40% by weight silicon.

8. The method of claim 1 wherein said fuel includes at least one electrically conductive element which facilitates said flow of electric current through said fuel.

9. The method of claim 2 wherein said fuel includes at least one electrically conductive element which facilitates said flow of electric current through said fuel.

* * * * *